US005109736A

United States Patent [19]

Dixon

[11] Patent Number: 5,109,736

[45] Date of Patent: May 5, 1992

[54] AUTOMATIC ASSEMBLY MACHINE WITH STEERING/UP-DOWN CONTROL HANDLE

[75] Inventor: Paul H. Dixon, Belvidere, Ill.

[73] Assignee: Dixon Automatic Tool, Inc., Rockford, Ill.

[21] Appl. No.: 661,185

[22] Filed: Feb. 27, 1991

Related U.S. Application Data

[63] Continuation-in-part of Ser. No. 560,854, Jul. 27, 1990, abandoned.

[51] Int. Cl.[5] ..... B25B 29/00

[52] U.S. Cl. ..... 81/57.4; 29/240

[58] Field of Search ..... 81/57.37, 57.4: 29/240; 173/170; 227/110, 111

[56] References Cited

U.S. PATENT DOCUMENTS 3,279,045 10/1966 Dixon ..... 29/240 X
3,333,613 8/1967 Bosse ..... 81/57.4
3,675,302 7/1972 Dixon ..... 29/240 X
3,694,888 10/1972 Bosse ..... 81/57.4 X
3,910,325 10/1975 Dixon ..... 81/57.4 X

*Primary Examiner*—James G. Smith
*Attorney, Agent, or Firm*—Leydig, Voit & Mayer

[57] ABSTRACT

An automatic screwdriver is mounted on a cantilevered support to move horizontally to various positions above a workpiece and also to move vertically to drive screws into the workpiece. A depending handle with a hand grip is used to steer the screwdriver horizontally. Up and down movement of the handle relative to the screwdriver causes a power actuator to shift the screwdriver vertically to drive a screw and to retract the screwdriver preparatory to driving of the next screw. The handle may be selectively pivoted between positions enabling either right-hand or left-hand operation of the handle.

11 Claims, 9 Drawing Sheets

Fig. 3.
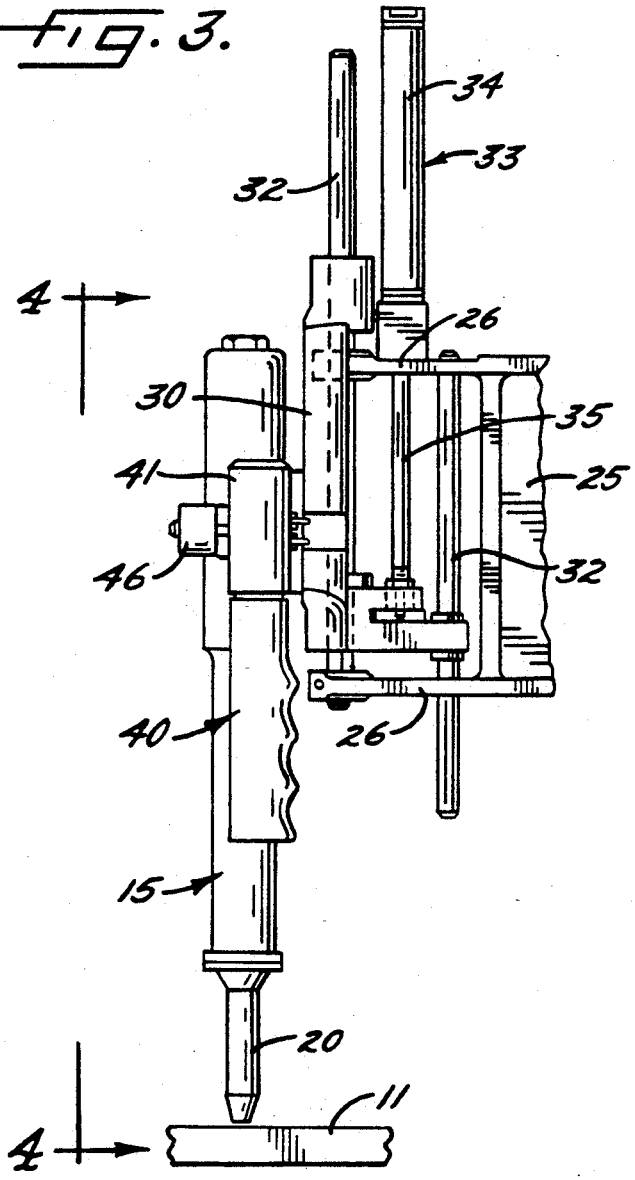
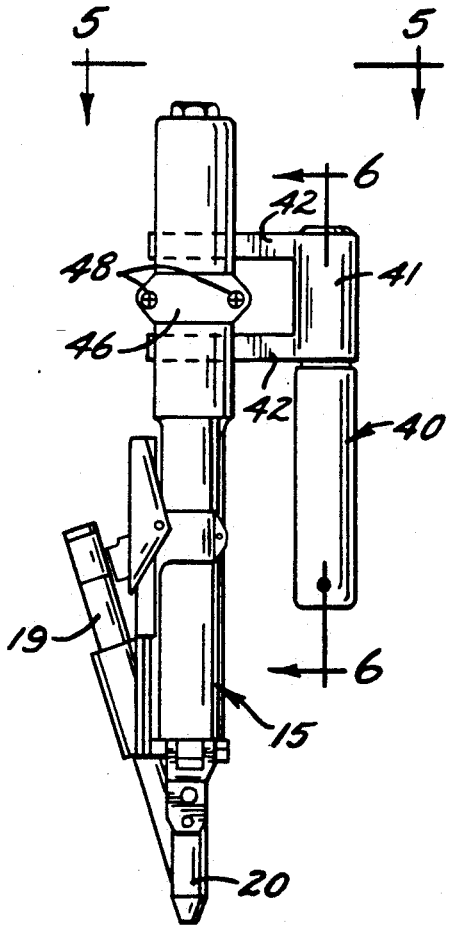
Fig. 4.

REG. V
75
AIR SUPPLY
81
80
36
33
34
37
35
60
65
15
66
40
17

AUTOMATIC ASSEMBLY MACHINE WITH STEERING/UP-DOWN CONTROL HANDLE

CROSS-REFERENCE TO A RELATED APPLICATION

This application is a continuation-in-part of my copending application Ser. No. 560,854, filed Jul. 27, 1990, now abandoned.

BACKGROUND OF THE INVENTION

This invention relates to an automatic assembly machine and, more particularly, to an assembly machine of the type having an automatic fastener driver for assembling screws, nuts and the like with workpieces.

Automatic assembly machines of the same general type as the machine of the present invention are disclosed in Dixon U.S. Pat. No. 3,279,045; Dixon U.S. Pat. No. 3,675,302; and Dixon U.S. Pat. No. 3,910,325. The fastener drivers of such machines include a rotary motor operable to drive a screwdriver bit, a socket wrench or other tool; the fasteners being fed one-by-one to the tool. The machines are used by moving the fastener driver horizontally to an appropriate position over a workpiece and then by moving the driver downwardly to effect assembly of the fastener with the workpiece. The fastener driver then is retracted upwardly and is repositioned horizontally to a different position over the workpiece preparatory to driving the next fastener.

The fastener driver disclosed in Dixon U.S. Pat. No. 3,910,325 is basically a hand-held unit and has extreme flexibility of positioning. Because the driver is hand-held, however, the operator's wrist is subjected to a flexing force as the fastener is torqued down by the power-rotated tool. After the operator uses the fastener driver over a prolonged period of time, the repeated flexure of the wrist may lead to carpal tunnel syndrome.

In the fastener drivers of Dixon U.S. Pat. Nos. 3,279,045 and 3,675,302, the operator grips a handle-like member to steer the tool to different locations and pushes and releases a thumb button in order to control a power-operated actuator for effecting up and down movement of the tool. The thumb button is positioned above the handle-like member and becomes tiring and uncomfortable to operate over the course of a work shift.

SUMMARY OF THE INVENTION

The general aim of the present invention is to provide a new and improved automatic assembly machine of the foregoing type having a unique handle which is used both to steer and to effect up and down movement of the fastener driver and which provides greater operator comfort and ease of operation than has been possible heretofore.

A more detailed object of the invention is to achieve the foregoing by providing an automatic assembly machine which is equipped with a depending handle which may be gripped comfortably by the operator in order to steer the fastener driver and which may be bodily moved upwardly and downwardly in order to control the power-operated actuator for effecting up and down movement of the driver.

A further object of the invention is to provide a handle which is capable of turning with the hand of the operator and relative to the fastener driver and which is capable of being quickly changed over between right-hand operation and left-hand operation.

Still another object is to provide a handle which remains at a substantially fixed elevation as the fastener driver moves upwardly and downwardly.

The invention also resides in the unique incorporation of a pilot valve into a steering handle, the pilot valve being responsive to up and down movement of the handle to control the up-down actuator of the fastener driver.

These and other objects and advantages of the invention will become more apparent from the following detailed description when taken in conjunction with the accompanying drawings.

BRIEF DESCRIPTION OF THE DRAWINGS

FIG. 3 is fragmentary view of the machine illustrated in FIG 2 but shows the fastener driver lowered to its driving position.

FIG. 4 is an elevational view of the fastener driver as seen from the line 4—4 of FIG. 3.

DETAILED DESCRIPTION OF THE PREFERRED EMBODIMENT

Figure 1:
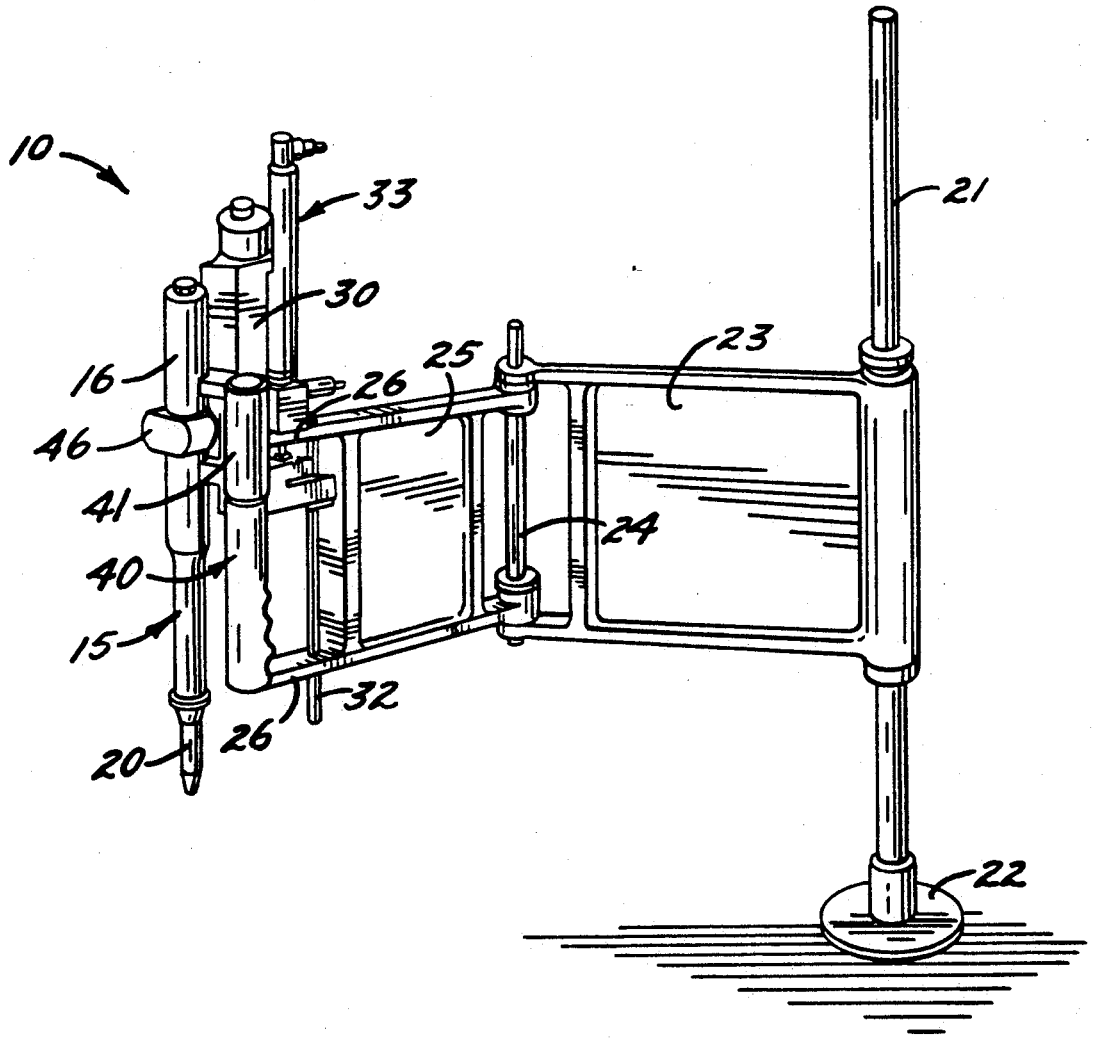
FIG. 1 is a perspective view of one embodiment of a new and improved automatic assembly machine incorporating the unique features of the present invention.

For purposes of illustration, the invention has been shown in the drawings as incorporated in an automatic assembly machine 10 operable to drive threaded fasteners (not shown) into a workpiece 11 (FIG. 3). While various types of fasteners may be handled by the machine, the fasteners typically are screws.

Figure 2:
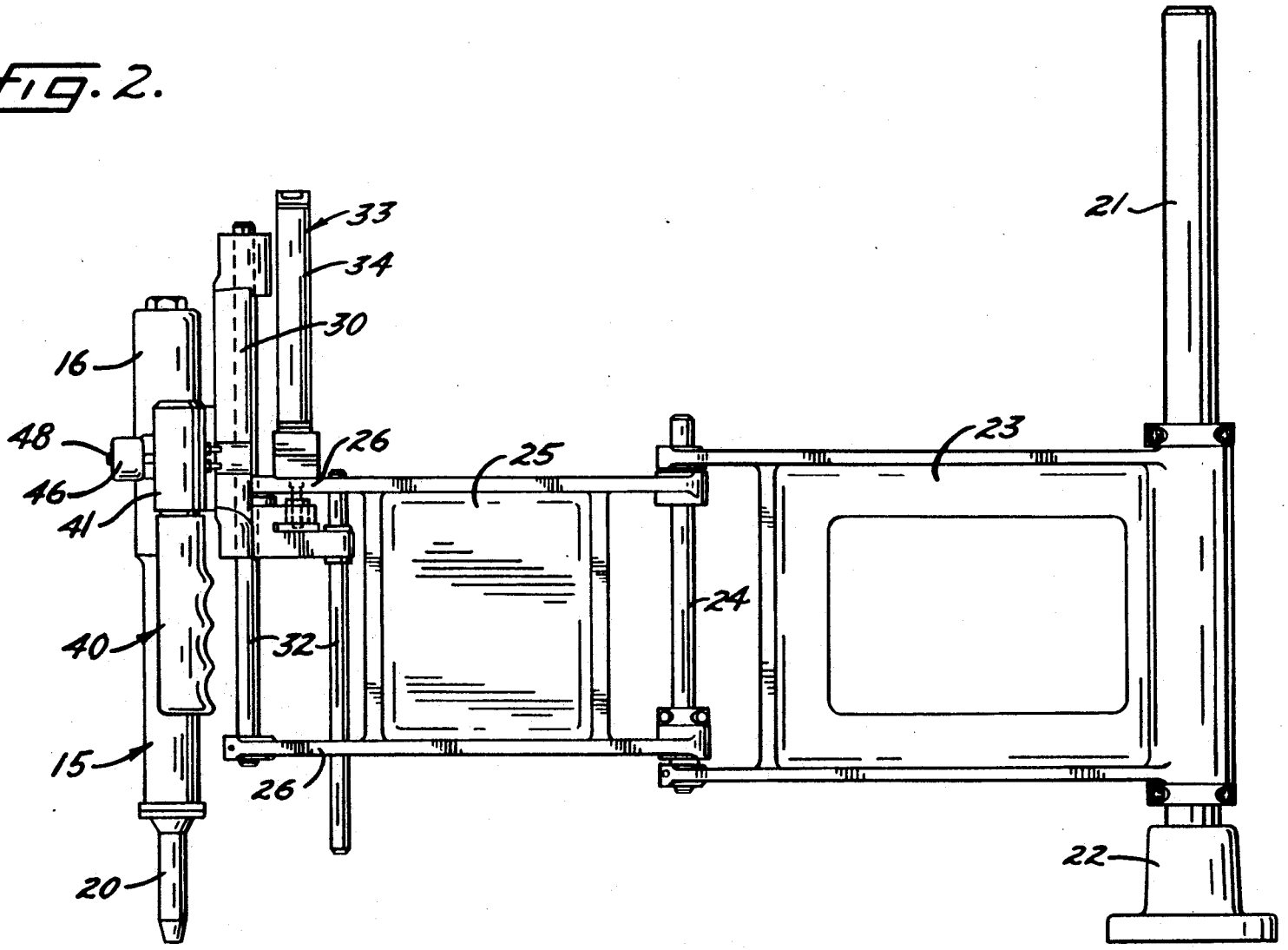
FIG. 2 is side elevational view of the machine illustrated in FIG. 1 and shows the fastener driver in its upwardly retracted position.
Figure 8:
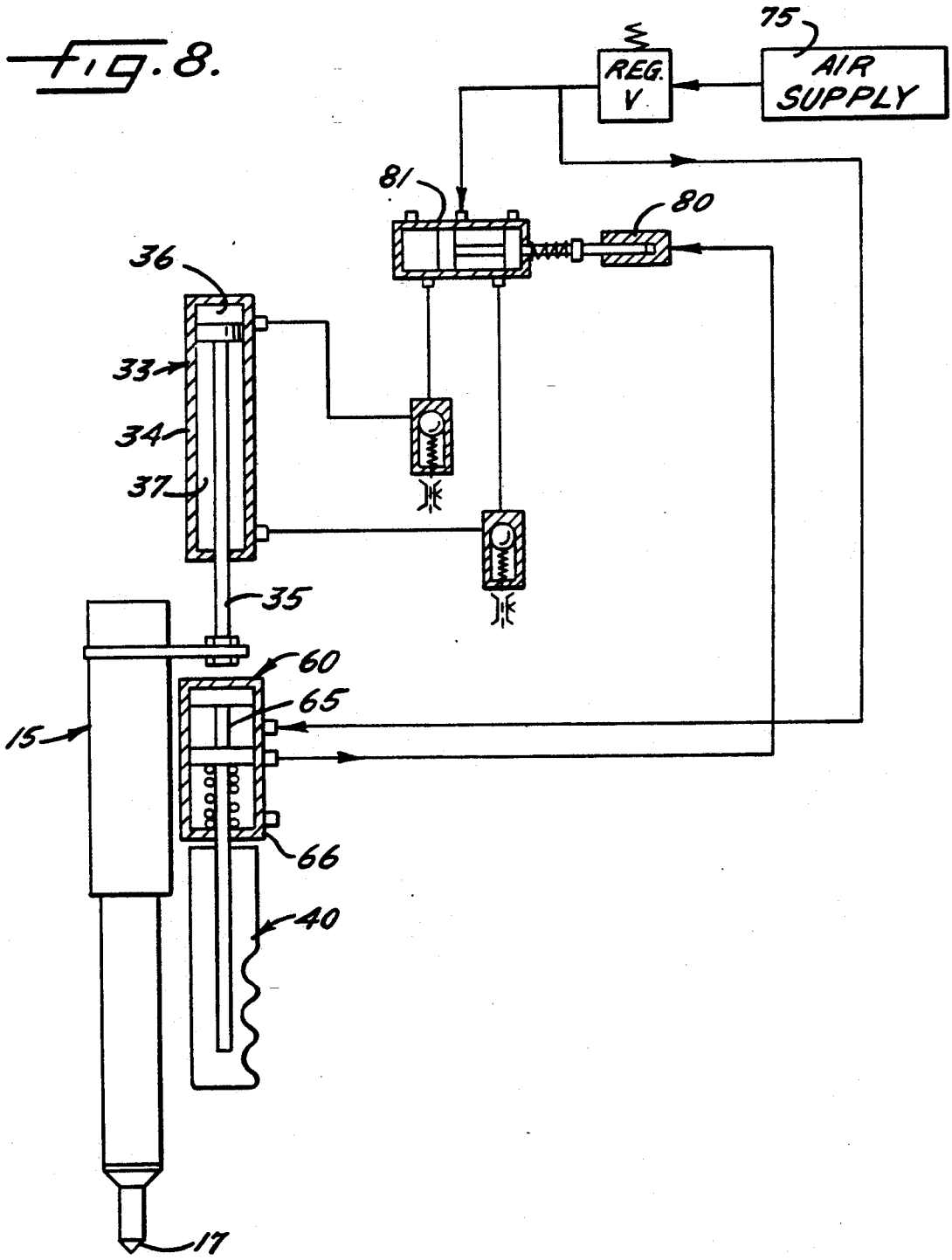
FIG. 8 is a diagram of a pneumatic circuit for controlling the upward and downward movement of the fastener driver.

The machine 10 includes an automatic fastener driver 15 having a rotary air motor 16 operable to rotate a bit 17 (FIG. 8). Screws are fed through a delivery tube 19 (FIG. 4) to a chuck 20, are rotated by the bit and are driven into the workpiece 11 as the fastener driver 15 is shifted downwardly to an active or driving position shown in FIG. 3. After the screw has been driven, the driver 15 is raised upwardly to a retracted position (FIG. 2) and is horizontally relocated to a different position over the workpiece preparatory to driving of the next screw.

In many respects, the screwdriver 10 is supported in a manner similar to the screwdriver of FIGS. 20 to 23 of Dixon U.S. Pat. No. 3,675,302. Thus, a post 21 upstands from a base 22 and pivotally supports a horizontally extending cast bracket 23 whose free end carries a vertically extending rod 24. A second horizontally extending cast bracket 25 is pivotally supported on the rod 24 and its free end portion is formed with a pair of vertically spaced and horizontally extending arms 26 which carry the screwdriver 15. Accordingly, the two brackets 23 and 25 form a cantilevered support in the nature of two articulated sections which may be swung about the post 21 and the rod 24, respectively, to enable the screwdriver to be moved horizontally to various side-to-side and front-to-rear positions and thereby permit placement of screws at different locations above the workpiece 11.

The screwdriver 15 is anchored rigidly to a carriage 30 which, in turn, is supported to slide upwardly and downwardly on vertically extending rods 32 connected to and extending between the arms 26. Up and down movement of the carriage is effected by a reciprocating pneumatic actuator 33 having a cylinder 34 supported on the upper arm 26 and having a downwardly extending rod 35 (FIG. 3) whose lower end is connected to the carriage 30. When pressurized air is admitted into the upper chamber 36 (FIG. 8) of the cylinder, the carriage 30 and the screwdriver 15 are shifted downwardly through a driving stroke from the retracted position of FIG. 2 to the active driving position of FIG. 3. Conversely, pressurization of a lower chamber 37 of the cylinder effects upward return of the carriage and the screwdriver to the position shown in FIG. 2.

In accordance with the present invention, the machine 10 is equipped with a manually operable depending handle 40 which is used not only to steer the screwdriver 15 to various horizontal positions but also to control the actuator 33 and thereby control up and down movement of the screwdriver. The handle is particularly characterized in that it provides extreme comfort for the operator of the machine and enables the operator to rapidly cycle the machine over a long period of time without experiencing extreme fatigue or discomfort and without subjecting the operator's hand and wrist to motions which might lead to carpal tunnel syndrome.

Figure 5:
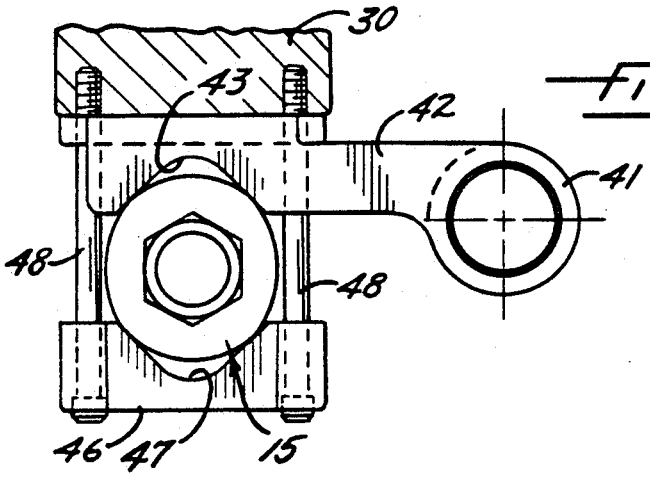
FIG. 5 is an enlarged fragmentary top plan view as seen from the line 5—5 of FIG. 4, certain parts being broken away and shown in section.

More specifically, the handle 40 is supported beneath a bracket 41 (FIGS. 4 and 5) having upper and lower horizontally extending arms 42 which are fastened rigidly to the carriage 30. The arms are notched as indicated at 43 in FIG. 5 to form a seat for the screwdriver 15. A clamp 46 with a similar notch 47 is disposed opposite the arms and is located vertically between the arms so as to coact with the arms to define a cradle for the screwdriver. Screws 48 secure the clamp 46 to the carriage 30 and, when the screws are tightened, the screwdriver 15 is locked between the arms 42 and the clamp 46 and thus is secured rigidly to the carriage.

Figure 6:
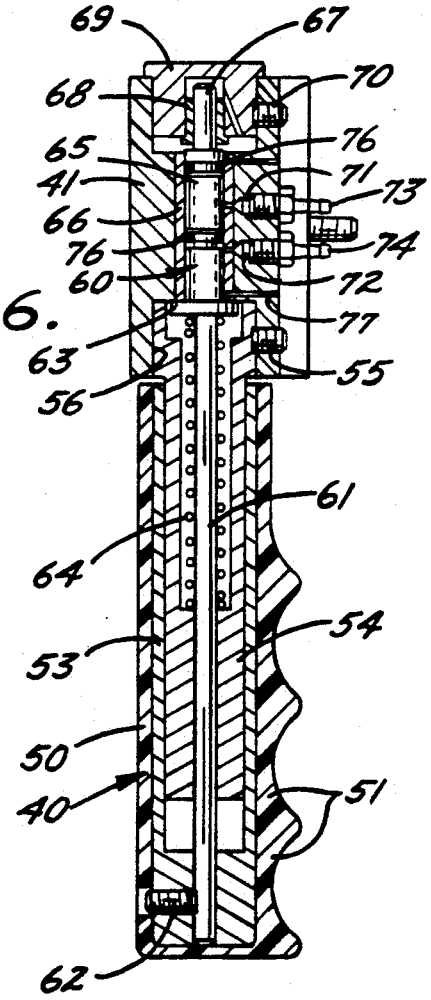
FIG. 6 is an enlarged cross-section taken substantially along the line 6-6 of FIG. 4.

As shown most clearly in FIG. 6, the handle 40 includes a grip 50 which is made of vinyl plastic and which is scalloped along one side as indicated at 51 to accommodate the fingers of the operator. The resilient handle grip 50 is contracted tightly around a tubular core 53 (FIG. 6) which, in turn, is telescoped slidably over an inner sleeve 54. The sleeve extends downwardly from the bracket 41 and its upper end portion is fixed rigidly by a set screw 55 within a bore 56 in the lower end portion of the bracket.

Figure 7:
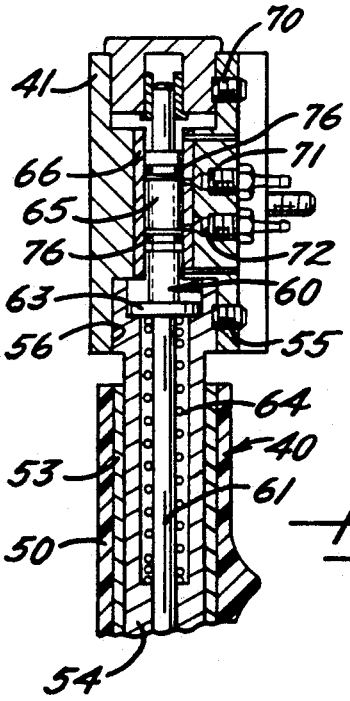
FIG. 7 is a fragmentary view similar to FIG. 6 but shows the steering handle in its actuated position.

In carrying out the invention, a pilot valve 60 (FIGS. 6 to 8) is associated with the handle 40 and is adapted to be actuated by moving the handle upwardly and downwardly on the sleeve 54. Herein, the valve includes an elongated stem 61 which extends slidably through the lower end portion of the sleeve 54 and whose lower end portion is piloted into the bottom end portion of the handle core 53 and is fastened rigidly thereto by a set screw 62. A disc 63 on the upper end of the stem 61 normally is located at the upper end of the bore 56 and normally is pressed upwardly against the bracket 41 by a coil spring 64 telescoped over the stem and compressed between the disc 63 and a portion of the fixed sleeve 54.

A valve element or spool 65 (FIGS. 6 to 8) is carried by the stem 61 above the disc 63 and is adapted to slide upwardly and downwardly in a valve housing 66 which is fixed within the bracket 41. An upper extension 67 (FIG. 6) of the spool 65 is guided slidably by a bushing 68 which is fitted into a cap 69 at the upper end of the bracket 41, the cap being secured to the bracket by a set screw 70.

The valve housing 66 is formed with two axially spaced ports 71 and 72 (FIG. 6) which communicate with barbed fittings 73 and 74, respectively, adapted to be connected to flexible air lines. Pressurized air from a supply 75 (FIG. 8) is adapted to be introduced into the valve housing 66 via the fitting 73 and the port 71. When the handle 40 is in its normal unactuated position shown in FIG. 6, O-rings 76 on the valve spool 65 seal off the port 71 from the port 72 and prevent the flow of pressurized air to the port 72. With the valve spool in this position, the port 72 is vented to atmosphere through a passage 77 in the housing 66 and the bracket 41. When the handle 40 is pulled downwardly to its actuated position shown in FIG. 7, the spool 65 is shifted downwardly to permit pressurized air from the port 71 to flow out of the fitting 74 via the port 72.

In operation of the machine 10, the operator grips the handle 40 and, through use of the handle, steers the screwdriver 15 horizontally to a desired position above the workpiece 11. After the screwdriver has been horizontally positioned, the operator pulls downwardly on the handle 40 to shift the valve spool 65 from the position shown in FIG. 6 to the position shown in FIG. 7. As a result, pressurized air from the supply 75 flows from the port 71 to the port 72. The pressurized air from the port 72 is directed to the pilot actuator 80 (FIG. 8)

of a spring-loaded relay valve 81 thereby to shift the valve member of the valve. Air then is directed from the supply 75 to the upper chamber 36 of the actuator 33 to move the screwdriver 15 through its downstroke.

Once the screw has been tightened, the operator jogs the handle 40 upwardly. This causes the valve spool 65 to return to the position shown in FIG. 6. By virtue thereof, the pilot actuator 80 of the relay valve 81 is vented to atmosphere by way of the passage 77 in the pilot valve 60. The relay valve 81 then is spring-returned to the position shown in FIG. 8 in order to exhaust the upper chamber 36 of the actuator 33 and to direct pressurized air to the lower chamber 37. As a result, the screwdriver 15 is retracted upwardly preparatory to being horizontally repositioned.

If the operator releases the handle 40 at any time during the downstroke, the spring 64 returns the valve spool 65 upwardly to effect retraction of the screwdriver 15. Accordingly, the screwdriver is retracted automatically if the operator loses grip of the handle or if fast retraction is required to avoid a jam or injury.

From the foregoing, it will be apparent that the same depending handle 40 which is used to steer the screwdriver 15 also is used to control up and down movement of the screwdriver. The handle 40 increases operator comfort and avoids the need of using any thumb motion to effect the up and down movement.

While the screwdriver 15 has been specifically disclosed in connection with an articulated support 23, 25, those familiar with the art will appreciate that the screwdriver could be mounted on a coordinately movable support. Also, the handle 40 could be used to directly shift a main control valve for the actuator 33 or to operate different types of controls for an up/down actuator.

Another embodiment of an automatic assembly machine 10' incorporating the features of the invention is shown in FIGS. 9 to 18 in which parts corresponding to those of the machine 10 of the first embodiment are indicated by the same but primed reference numerals. The machine 10' is particularly characterized in that the handle 40' may be quickly and easily changed over from right-hand operation to left-hand operation or vice versa. In addition, the handle 40' remains at a substantially fixed elevation during up and down reciprocation of the screwdriver 15' and is capable of turning relative to the screwdriver and with the hand of the operator so as to provide greater operator comfort and convenience.

As shown in FIGS. 9, 11, 12, and 14, the rear end of a generally U-shaped mounting bracket or arm 85 is attached to the articulated bracket 25' by a pair of vertically spaced screws 86, each screw extending through a hole 87 (FIG. 11) in the articulated bracket 25' and being threaded into a tapped hole 88 in the rear end of the arm 85. The forward end of the arm 85 is formed with a pair of vertically spaced ears 89 and 90 (FIG. 10) which are adapted to be straddled by a pair of vertically spaced ears 91 and 92 formed integrally with and projecting radially from a bracket 41'. A pin 93 (FIG. 17) extends through holes 94 in the ears 91 and 92, through holes 95 in the ears 89 and 90, is pivotally received in the holes 94 and is anchored to the ears 89 and 90 by set screws 96 (FIG. 10). Thus, the pin 93 supports the bracket 41' and the attached handle 40' on the arm 85 for pivoting about an upright axis relative to the screwdriver 15'.

Figures 9, 10:
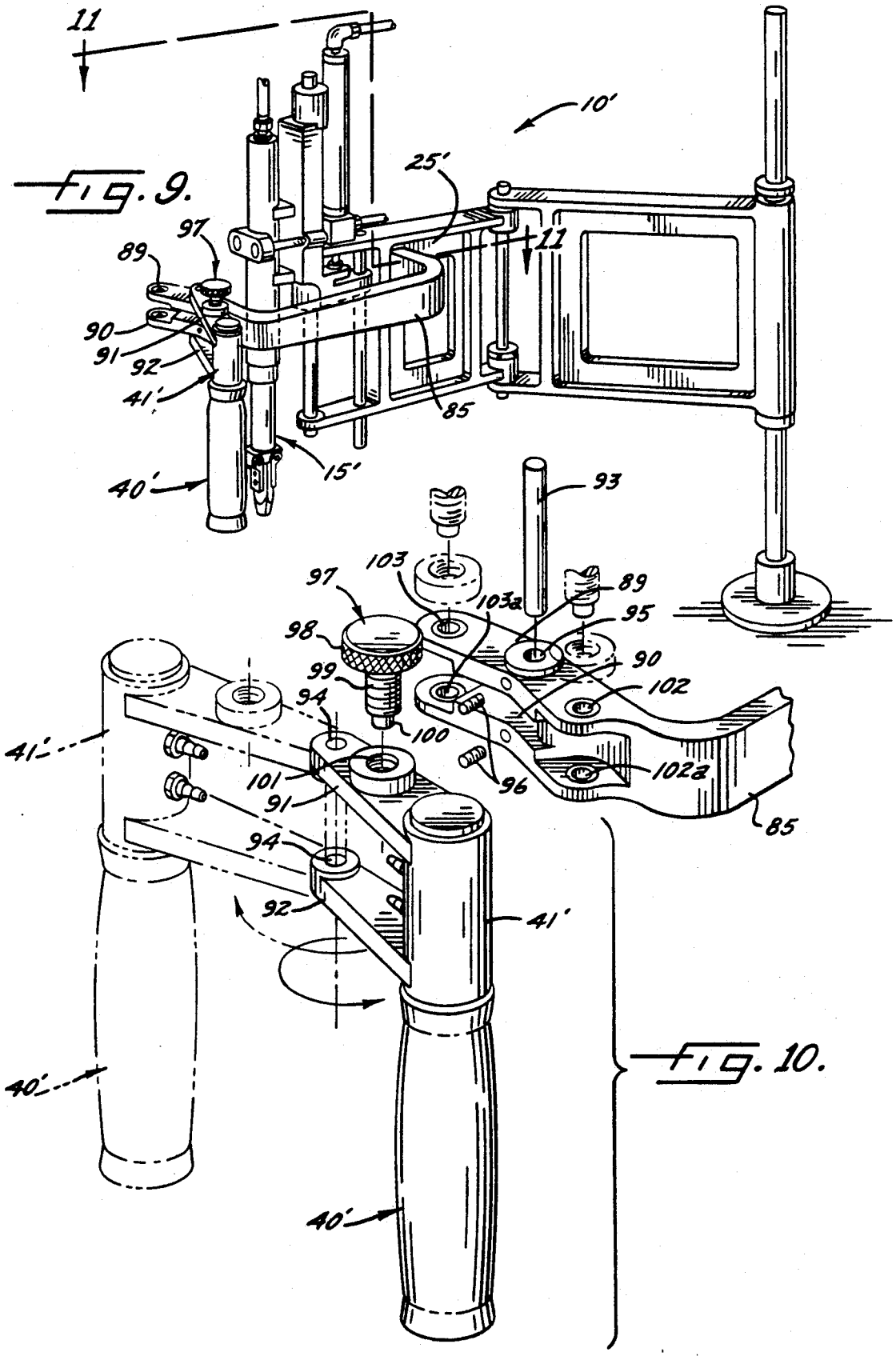
FIG. 9 is a perspective view of another embodiment of an assembly machine constructed in accordance with the invention.
FIG. 10 is an exploded perspective view of the handle and related components of the machine shown in FIG. 9.
Figure 11:
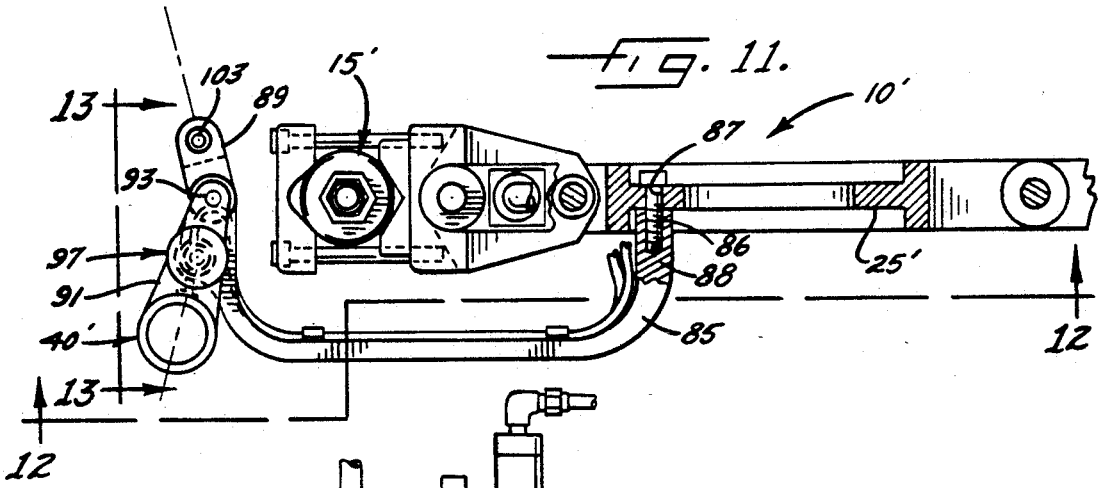
FIG. 11 is an enlarged fragmentary top plan view as seen substantially from the line 11—11 of FIG. 9 and shows the handle installed on the right side of the machine and positioned for right-hand operation.
Figure 12:
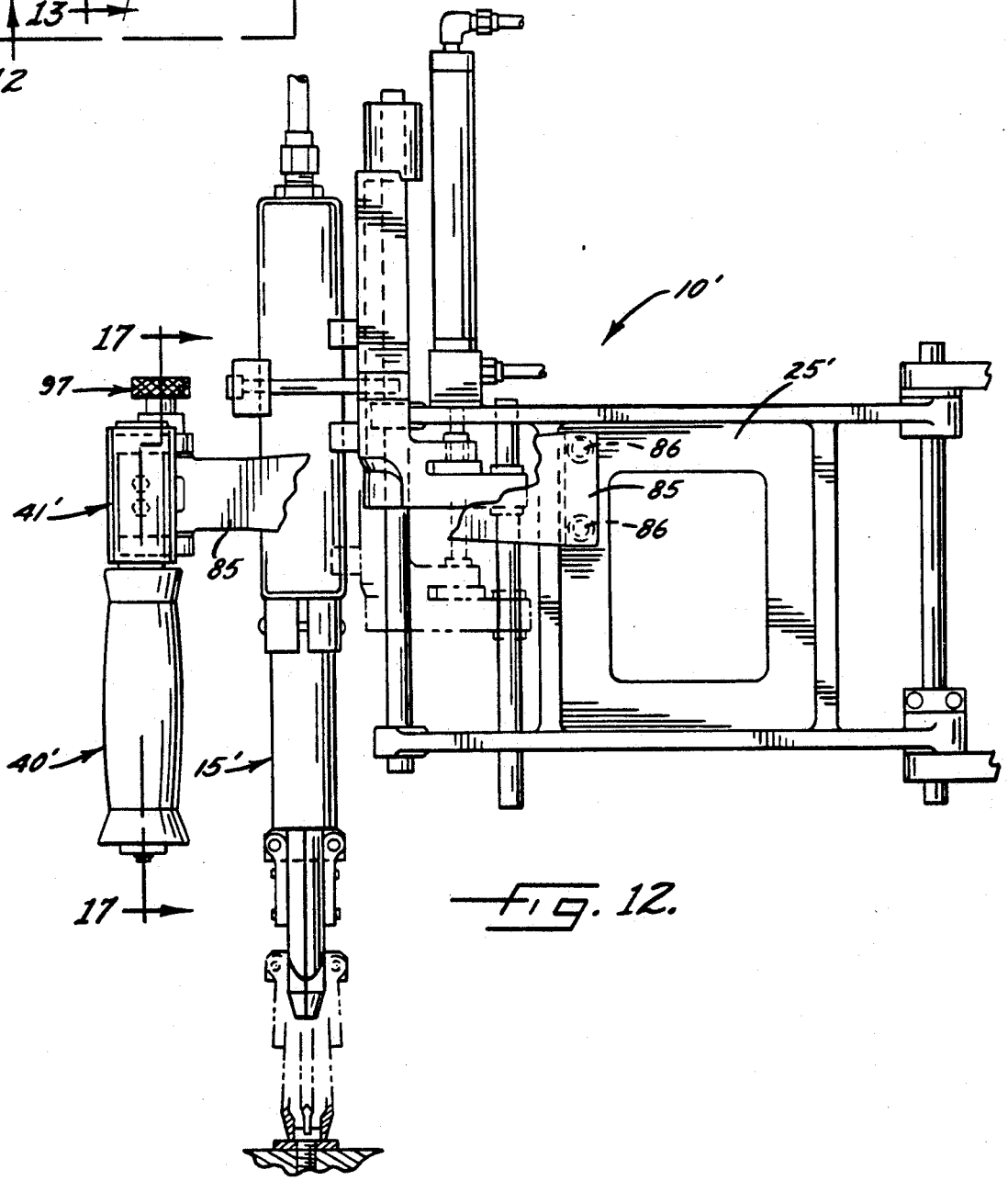
FIG. 12 is a fragmentary side elevational view as seen substantially from the line 12—12 of FIG. 11.
Figure 13:
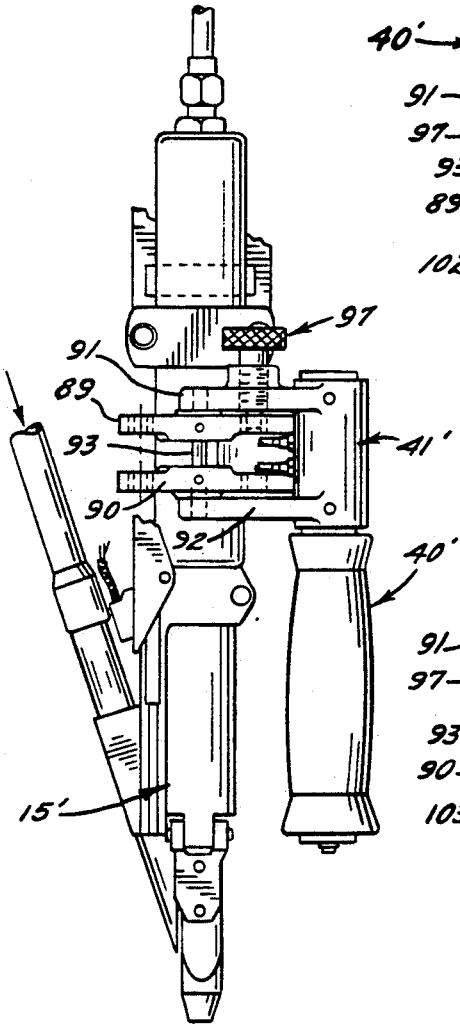
FIG. 13 is a fragmentary front elevational view as seen substantially from the line 13—13 of FIG. 11.

In FIGS. 9 and 11, the arm 85 has been shown as installed on the right side of the articulated bracket 25' and the handle 40' has been shown as positioned on the right side of the screwdriver 15' for operation by the right hand of the operator. The handle is adapted to be releasably retained in this position by a dogpoint screw 97 (FIG. 10) having a knurled head 98, a threaded shank 99 and a reduced diameter stem 100. The shank 99 is threaded into a hole 101 in the ear 91 and, when the handle 40' is positioned for right-hand operation, the stem 100 projects into a bushed hole 102 (FIGS. 10 and 17) in the ear 89 when the screw 97 is fully tightened. Accordingly, the screw prevents the bracket 41' from pivoting about the pin 93 and retains the handle 40' in position for right-hand operation.

Figure 14:
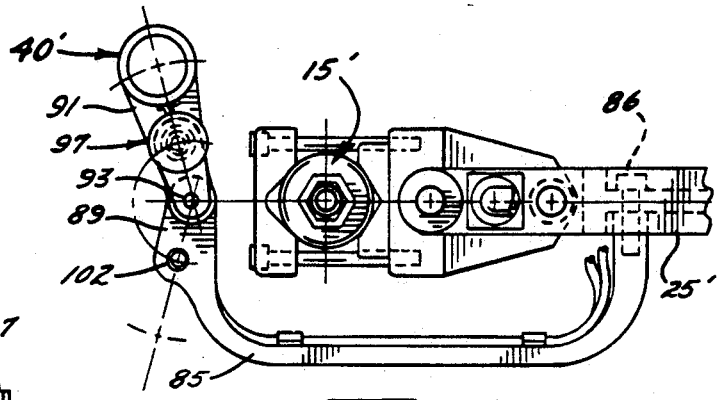
FIG. 14 is a fragmentary top plan view similar to FIG. 11 but shows the handle positioned for left-hand operation.

By loosening the screw 97, the stem 100 may be retracted out of the hole 102 in the ear 89. This frees the bracket 41' for swinging about the pin 93 to enable the handle 40' to be positioned to the left of the screwdriver 15' for left-hand operation as shown in FIG. 14. When the screw 97 is subsequently tightened, the stem 100 enters a second bushed hole 103 (FIGS. 10 and 17) in the ear 89 and retains the handle in position for left-hand operation. Accordingly, the handle may be switched between right-hand and left-hand positions in a quick and easy manner in order to accommodate either a right-handed operator or a left-handed operator.

Figure 15:
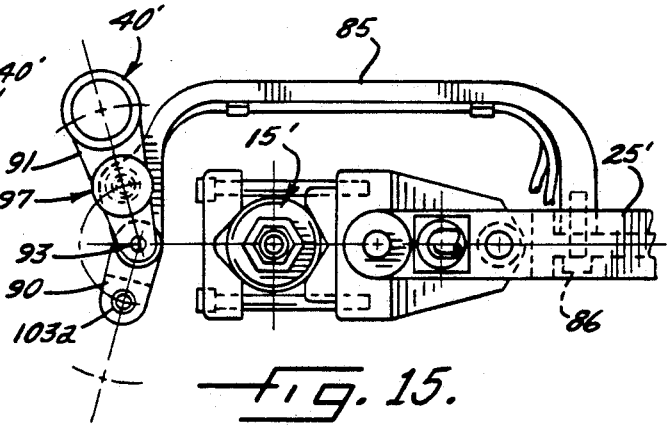
FIG. 15 is a fragmentary top plan view showing the handle installed on the left side of the machine and positioned for left-hand operation.
Figure 16:
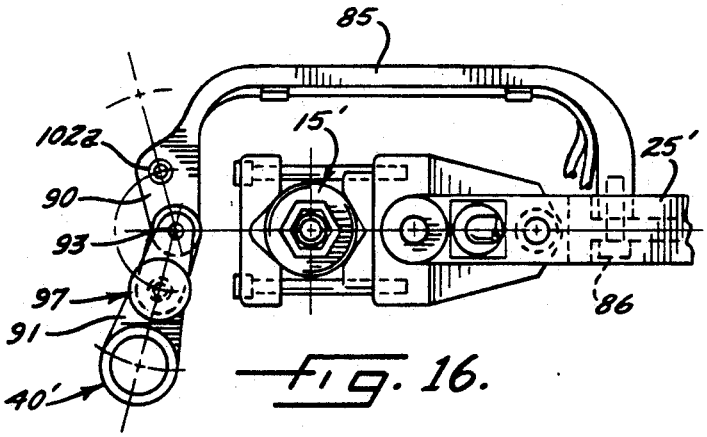
FIG. 16 is a view similar to FIG. 15 but shows the handle positioned for right-hand operation.
Figure 17:
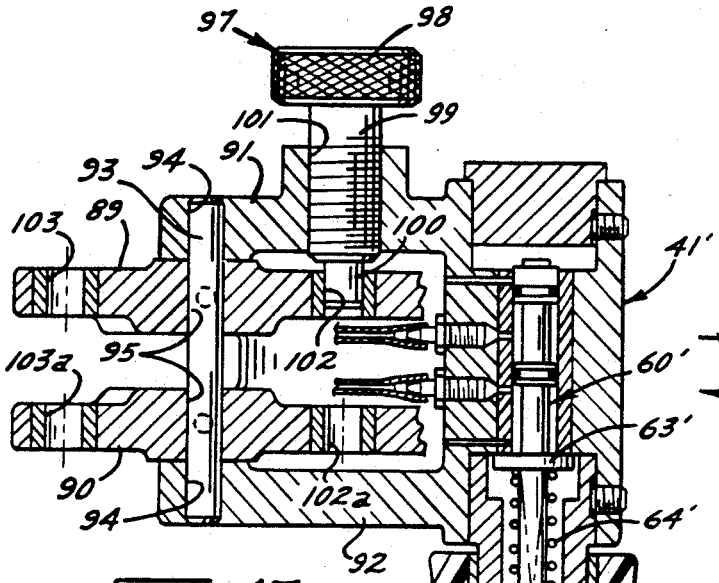
FIG. 17 is an enlarged cross-section taken substantially along the line 17—17 of FIG. 12 and shows the handle in its normal, unactuated condition.
Figure 19:
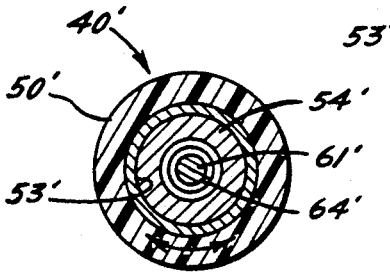
FIG. 19 is a cross-section taken along the line 19—19 of FIG. 17.
Figure 18:
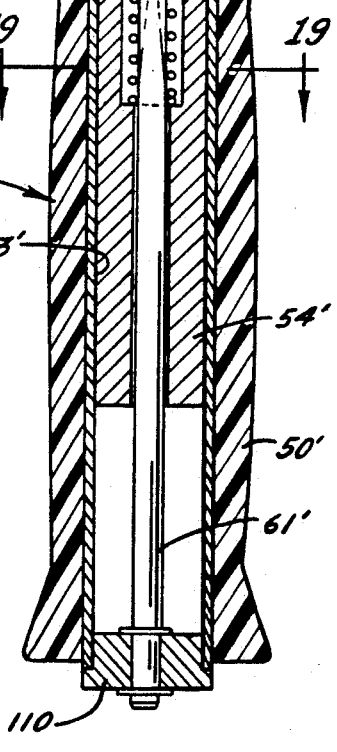
FIG. 18 is a fragmentary view similar to FIG. 17 but shows the handle in its actuated position.
Figure 18:
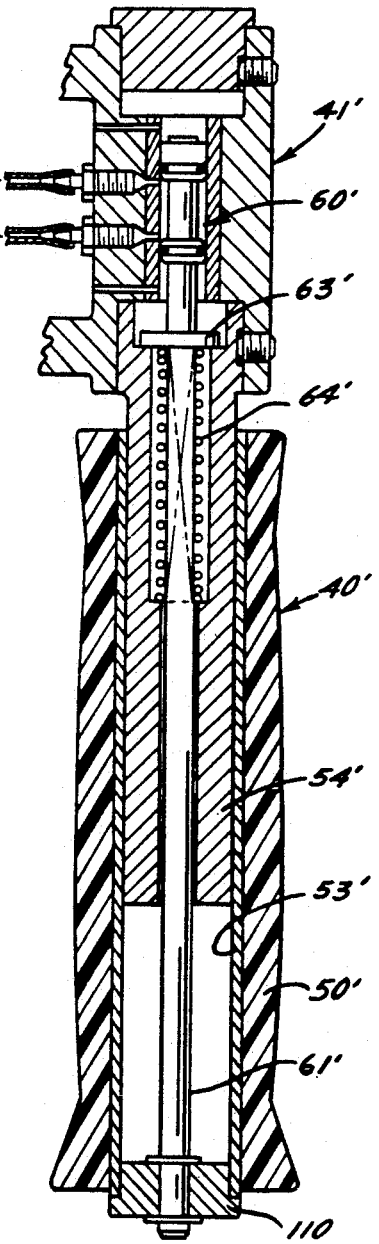

Advantageously, the mounting arm 85 may be switched from the right side of the bracket 25' to the left side thereof if space limitations adjacent the right side of the machine 10' so dictate. This is achieved by removing the screws 86, by inverting the arm 85, by positioning the arm on the left side of the bracket 25' and by re-installing the screws 86. Thus, the arm 85 may be located on the left side of the machine as shown in FIG. 15 and the handle 40' may be pivoted from the left-hand operation of FIG. 15 to the right-hand operation of FIG. 16. To enable the screw 97 to retain the handle 40', the ear 92 is formed with two bushed holes **102*a* and 103*a* (FIGS. 10 and 17) which are aligned vertically with the holes 102 and 103, respectively, and which alternately receive the stem 100 of the screw 97 when the arm 85 is inverted and installed on the left side of the bracket 25'**.

A further advantage of the machine 10' is that the handle 40' remains at a substantially fixed elevation by virtue of the handle being supported by means of the vertically fixed bracket 41' and arm 85. Accordingly, the handle 40' does not reciprocate upwardly and downwardly with the screwdriver 15' and thus provides greater operator comfort and convenience than does the reciprocating handle 40 of the machine 10 of the first embodiment. Comfort and convenience are further increased by virtue of the fact that the hand grip 50' (FIG. 17) of the handle 40' may rotate about the central axis of the handle and may turn with the operator's hand and relative to the screwdriver 15' as the operator steers the screwdriver to various horizontal positions. For this purpose, the hand grip 50' is contracted around a core 53' which is both slidable and rotatable on the sleeve 54'. A bushing 110 on the lower end of the stem 61' rotatably supports the lower end portion of the core and prevents the core from moving downwardly relative to the stem.

I claim:

1. An automatic assembly machine comprising a support having a first section and having a second section adapted to shift horizontally relative to said first section, an automatic fastener driver, means mounting said fastener driver on said second section of said support for up and down movement between a raised retracted position and a lowered driving position, said mounting means anchoring said fastener driver against rotation relative to said second section of said support, a power-operated actuator connected between said fastener driver and said second section of said support and selectively operable to move said driver upwardly and downwardly between said positions, and manually operable means for use in shifting said fastener driver and said second section of said support horizontally relative to said first section of said support and for controlling said actuator means thereby to control up and down movement of said fastener driver, said manually operable means comprising a downwardly extending handle movable with said second section of said support, said handle defining a grip which may be manually grabbed and manually pushed or pulled horizontally to effect horizontal shifting of said fastener driver and said second section of said support relative to said first section of said support, means mounting said handle for up and down movement relative to said fastener driver between a raised normal position and a lowered actuated position, means urging said handle upwardly to said normal position, and means responsive to downward movement of said handle to said actuated position to cause said actuator to move said fastener driver downwardly to said driving position and responsive to upward movement of said handle to said normal position to cause said actuator to move said driver upwardly to said retracted position.

2. An automatic assembly machine as defined in claim 1 in which said handle comprises a generally cylindrical central core and further comprises a plastic grip fitted onto said core, one side of said grip being formed with multiple scallops for accommodating the fingers of the operator of the machine.

3. An automatic assembly machine as defined in claim 1 in which said power-operated actuator comprises a reciprocating pneumatic actuator, said responsive means comprising a pilot valve communicating with a supply of pressurized air, said machine further comprising a relay valve controlled by said pilot valve and operable to control said actuator.

4. An automatic assembly machine as defined in claim 1 in which said handle includes a central and generally vertically extending axis, said handle being rotatable about said axis and relative to said second section of said support.

5. An automatic assembly machine as defined in claim 1 further including means supporting said handle on said support for pivoting about a vertical axis between a left-hand position and a right-hand position, and means for retaining said handle in either said left-hand position or said right-hand position and selectively releasable to permit said handle to pivot about said axis between said left-hand position and said right-hand position.

6. An automatic assembly machine as defined in claim 5 in which said supporting means comprise a first bracket attached to said second section of said support, a second bracket carrying said handle and pivotally attached to said first bracket, said retaining means being carried by said second bracket and being releasably engageable with said first bracket.

7. An automatic assembly machine as defined in claim 6 in which said second section of said support includes left and right sides, and means for attaching said first bracket to either the left side or the right side of said second section.

8. An automatic assembly machine as defined in claim 1 in which said handle is connected to said fastener driver and moves upwardly and downwardly with said fastener driver relative to said second section of said support.

9. An automatic assembly machine as defined in claim 1 in which said handle is connected to said second section of said support and remains at a fixed elevation except when shifted between said normal and actuated positions, said fastener driver moving upwardly and downwardly between said retracted position and said driving position without effecting vertical movement of said handle.

10. An automatic assembly machine comprising a support having a first section and having a second section adapted to pivot about an upright axis relative to said first section, an automatic fastener driver, means mounting said fastener driver on said second section of said support for up and down movement between a raised inactive position and a lowered driving position, a reciprocating pneumatic actuator connected between said fastener driver and said second section of said support, said actuator having upper and lower chambers and being operable to lower said fastener driver to said driving position when pressurized air is admitted into one of said chambers and to raise said fastener driver to said inactive position when pressurized air is exhausted from said one chamber, a control valve having a valve member shiftable to a first position to admit pressurized air into said one chamber and to a second position to exhaust pressurized air from said one chamber, said valve member shifting from one of its positions to the other of its positions in response to the pressurization of pilot air at said control valve and shifting reversely between its positions in response to depressurization of the pilot air, and manually operable means for use in pivoting said fastener driver and said second section of said support relative to said first section of said support and for controlling shifting of said valve member thereby to control up and down movement of said fastener driver, said manually operable means comprising a downwardly extending handle movable with said second section of said support, said handle defining a grip which may be manually grabbed and manually pushed or pulled horizontally to effect pivoting of said fastener driver and said second section of said support relative to said first section of said support, means mounting said handle for up and down movement relative to said fastener driver between a raised normal position and a lowered actuated position, means urging said handle upwardly to said normal position, a pilot valve having a valve element movable upwardly and downwardly with said handle, a supply of pressurized air communicating with said pilot valve, said valve element being operable to cause pressurized pilot air to be supplied at said control valve in response to movement of said handle in one direction between said normal and actuated positions and being operable to cause depressurization of the pilot air at said control valve in response to movement of said handle in the opposite direction between said normal and actuated positions.

11. An automatic assembly machine as defined in claim 10 in which said valve element of said pilot valve causes pressurized pilot air to be supplied at said control valve when said handle is pulled downwardly, said valve member of said control valve shifting to said first position in response to the pressurization of pilot air at said control valve.

* * * * *